US007370825B2

(12) United States Patent
Briante et al.

(10) Patent No.: US 7,370,825 B2
(45) Date of Patent: May 13, 2008

(54) TOWEL ROLL HOLDER AND DISPENSER AND BLANK FOR FORMING CONTAINER FOR THE TOWEL ROLL HOLDER AND DISPENSER

(76) Inventors: Dominic Briante, 4 Apricot Rd., Mount Sinai, NY (US) 11766; Mary P. Briante, 4 Apricot Rd., Mount Sinai, NY (US) 11766

( * ) Notice: Subject to any disclaimer, the term of this patent is extended or adjusted under 35 U.S.C. 154(b) by 219 days.

(21) Appl. No.: 11/288,738

(22) Filed: Nov. 29, 2005

(65) Prior Publication Data

US 2007/0176042 A1 Aug. 2, 2007

(51) Int. Cl.
*B65H 75/02* (2006.01)

(52) U.S. Cl. ..... 242/588.6

(58) Field of Classification Search ..... 242/588, 242/588.3, 588.6; 206/395, 396, 397, 408; 53/456, 458

See application file for complete search history.

(56) References Cited

U.S. PATENT DOCUMENTS 985,564 A * 2/1911 Adamson ..... 242/588.4
2,092,626 A * 9/1937 Simon ..... 206/395
3,134,525 A * 5/1964 Holcombe ..... 206/395
4,306,687 A * 12/1981 Hadtke ..... 242/588.4
5,246,111 A * 9/1993 Shibazaki et al. ..... 206/397
6,283,405 B1 * 9/2001 Tracy ..... 242/588.4
6,540,076 B1 * 4/2003 Elia et al. ..... 206/396
6,817,162 B1 * 11/2004 Gerulski et al. ..... 53/458
6,976,583 B2 * 12/2005 Horn ..... 206/395
2004/0016668 A1 * 1/2004 Horn ..... 206/395

* cited by examiner

*Primary Examiner*—William A Rivera
(74) *Attorney, Agent, or Firm*—Adams & Wilks

(57) ABSTRACT

A towel roll holder and dispenser has a housing for receiving a towel roll therewithin. The housing has a pair of sidewalls, a base connected to the sidewalls for mounting the housing on a support surface, and a pair of cover members pivotable in opposing directions between a closed position and an open position. One of the cover members has an opening through which towels may be dispensed from the towel roll. The cover members are releasably fastened to the sidewalls of the housing.

19 Claims, 11 Drawing Sheets

TOWEL ROLL HOLDER AND DISPENSER AND BLANK FOR FORMING CONTAINER FOR THE TOWEL ROLL HOLDER AND DISPENSER

BACKGROUND OF THE INVENTION

1. Field of the Invention

The present invention relates generally to devices for holding rolls of towels and, more specifically, to a device for supporting and enclosing a roll of continuous towel sheets such as paper towel sheets, and which facilitates dispensing of the sheets. The present invention also relates to a container blank made of a unitary sheet of material for forming a container for the towel roll holder and dispenser according to the present invention.

2. Background of the Invention

Rolls of towels, such as paper towels, have widespread use in both residential and commercial environments. Paper towels are typically dispensed from a roll of paper towels that is formed from a web of continuous paper towel sheets and are rolled about a tube. Several methods are known for dispensing such paper towels. In one method, the roll of paper towels is attached to a pair of brackets mounted underneath a cupboard or cabinet that includes spindles for engaging each end of the tube upon which the paper towels are rolled. When mounted in the horizontal orientation, the roll of paper towels is easily visible hanging from the cabinetry. Another method involves placing the paper towel roll over a vertical post mounted to a base and set on a countertop to stand vertically or mounted to a wall to extend outward horizontally. In either of these methods, the roll of paper towels is easily visible and can present an unsightly and cluttered appearance.

Moreover, another problem with the conventional paper towel dispensers is that they are not able to prevent the paper towels from becoming dirty due to, for example, handling of the roll of paper towels prior to or during dispensing of the paper towel sheets. This results in the paper towels being subjected to unclean and unsanitary conditions.

Many conventional paper towel holders and dispensers have been proposed which attempt to solve the foregoing problems in the conventional art. However, such paper towel holders and dispensers have a complex construction and are expensive to manufacture.

SUMMARY OF THE INVENTION

It is an object of the present invention to provide a highly decorative and functional device for holding and dispensing towel sheets from a roll of continuous sheets of towels.

It is another object of the present invention to provide a towel roll holder and dispenser which prevents towels from the roll from becoming dirty by keeping the towels in a clean and sanitary condition prior to being dispensed from the towel roll holder and dispenser.

A further object of the present invention is to provide a towel roll holder and dispenser that is simple and easy to use.

A still further object of the present invention is to provide a towel roll holder and dispenser that is easy and economical to manufacture.

A still further object of the present invention is to provide a container blank made of a unitary sheet of material for forming a container for the towel roll holder and dispenser according to the present invention.

The foregoing and other objects of the present invention are carried out, in one aspect, by a towel roll holder and dispenser comprising a main body having a bottom, a top, a rear wall, and a pair of opposing end walls defining an interior space for receiving a roll of towels for dispensing. A cover structure is pivotally attached to the main body for closing off the interior space of the main body when in a closed position. The cover structure has first and second cover members pivotable in opposing directions between the closed position and an open position and releasably held in the closed position. The first and second cover members and the main body together define an enclosure fully enclosing the roll of towels when the first and second cover members are in the closed position. The first cover member has a dispensing opening, such as an elongated aperture, through which a towel from the roll of towels can be dispensed from the enclosure when the first cover member is in the closed position.

The roll of towels is rotatively retained within the interior space of the main body between the pair of end walls so that a free portion of a towel from the roll of towels can extend through the elongated aperture of the first cover member. Preferably, tearing means, such as a serrated cutting member, is disposed along an edge of the elongated aperture for tearing off the free portion of the towel.

The first and second cover members are releasably held in the closed position by releasable fasteners, such as hook and loop fabric fastener tabs, mounted on the first and second cover members and on the side walls of the main body so as to releasably hold the first and second cover members to the side walls of the main body. Preferably, the enclosure is a one-piece structure made from a single piece of material, such as injection molded plastic.

In another aspect, the present invention is directed to a container blank made of a unitary sheet of material for forming a container for a towel roll holder and dispenser according to the present invention. The container blank comprises a plurality of first and second panels. The first panels are separated by a plurality of first fold lines about which the first panels are foldable to form a bottom, a top, a rear wall, a first cover member and a second cover member of the container. The second panels extend from opposite longitudinal edge portions of a preselected one of the first panels forming the bottom of the container. The second panels are separated from the longitudinal edge portions of the preselected panel by respective second fold lines about which the respective second panels are foldable to form opposing end walls of the container.

Preferably, the first panel forming the first cover member has a longitudinal slot disposed generally parallel to the first fold lines. The second panels have through-holes forming aligned apertures when the second panels are folded about the second fold lines to form the opposing end walls of the container. Preferably, the first panels form a generally rectangular-shaped structure, and each of the second panels is generally G-shaped.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
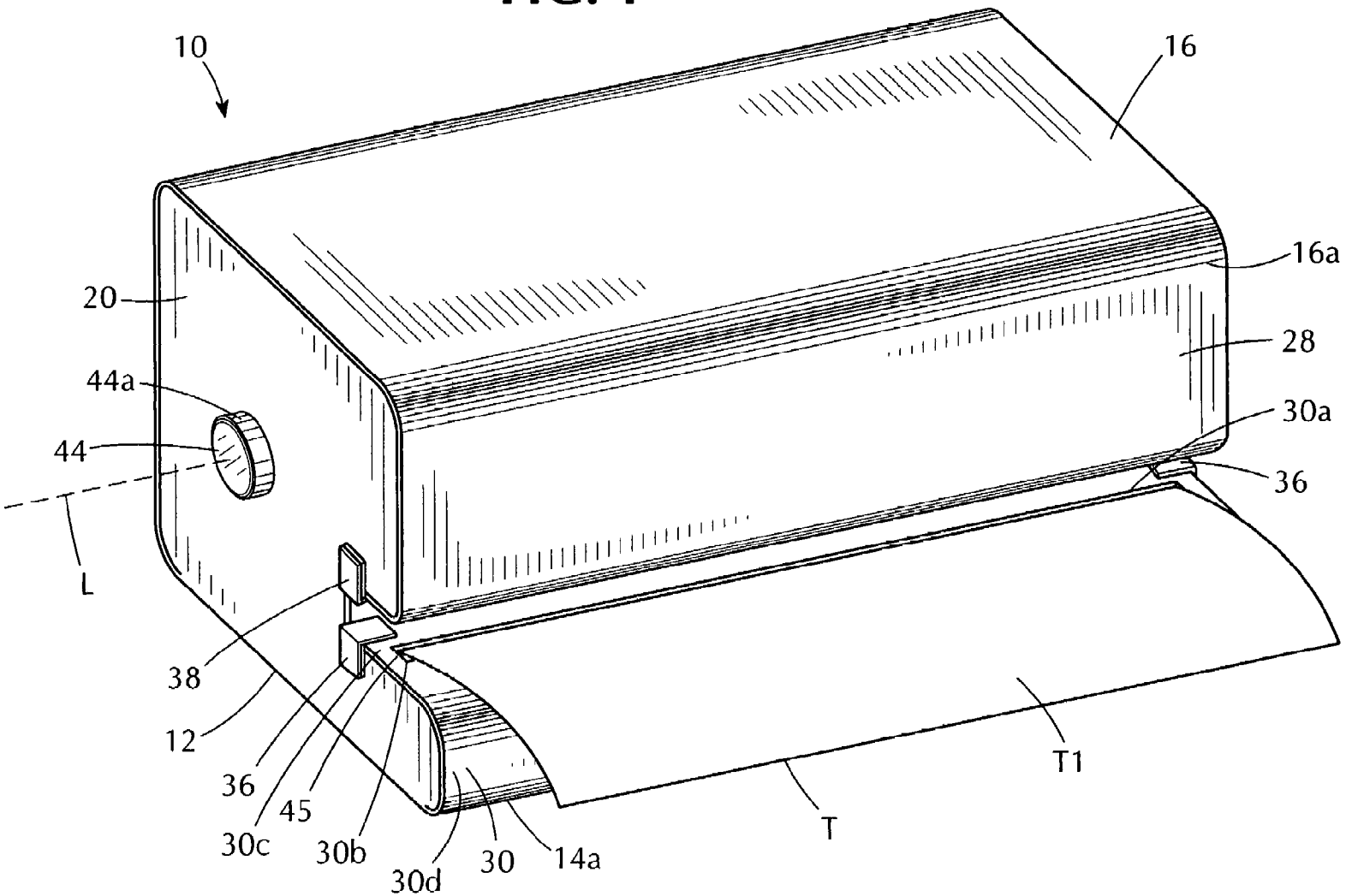
FIG. 1 is a perspective view of a towel roll holder and dispenser according to the present invention.

While this invention is susceptible of embodiments in many different forms, this specification and the accompanying drawings disclose only some forms as examples of the use of the invention. The invention is not intended to be limited to the embodiments so described, and the scope of the invention will be pointed out in the appended claims.

Certain terminology is used in the following description for convenience only and is not intended to be limiting. The words right, left, front, rear, upper, lower, bottom, top, horizontal and vertical designate directions in the drawing to which reference is made. Such terminology includes the words above specifically mentioned and words of similar import.

The preferred embodiment of the towel roll holder and dispenser is described below with a specific application to a roll of paper towels comprised of a plurality of severable sheets of paper wound together in a cylindrical roll. The individual sheets of paper are typically severed from the roll via transverse lines of perforations formed at predetermined intervals along the length of the roll. Such paper towel rolls are readily commercially available and known in the art. It should be noted, however, that the roll can be comprised of a plurality of other severable sheets such as toilet paper sheets or fabric softener sheets. Furthermore, it is understood that the sheets need not be limited to a material made of paper, but may also made of cloth or fabric. The present invention is also well adapted for dispensing wax paper, aluminum foil, plastic and the like for household or commercial use.

Referring now to the drawings in detail wherein like numerals have been used throughout the various figures to designate like elements, there is shown in FIGS. 1-8 an embodiment of a towel roll holder and dispenser, generally designated at 10, according to the present invention. The towel roll holder and dispenser 10 includes a main body 12 that has a bottom 14, a top 16, a rear wall 18, a pair of opposing end walls 20, 22, and an open front end 24. The bottom 14, top 16, rear wall 18, and opposing end walls 20, 22 of the housing define an open space 26 for receiving and containing a roll of wound material, such as a roll of paper towels T.

Figure 2:
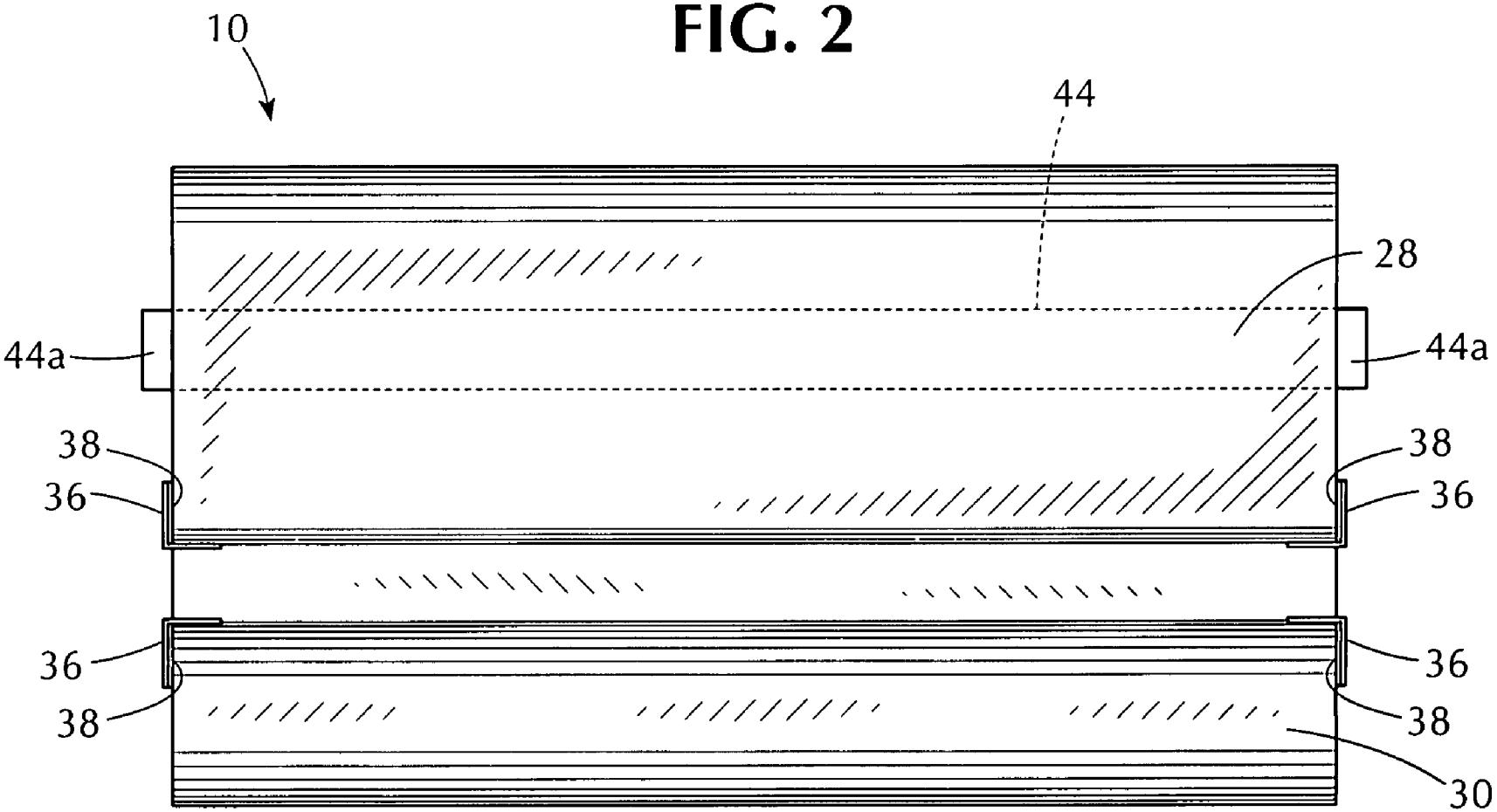
FIG. 2 is a front view of the towel roll holder and dispenser shown in FIG. 1.
Figure 3:
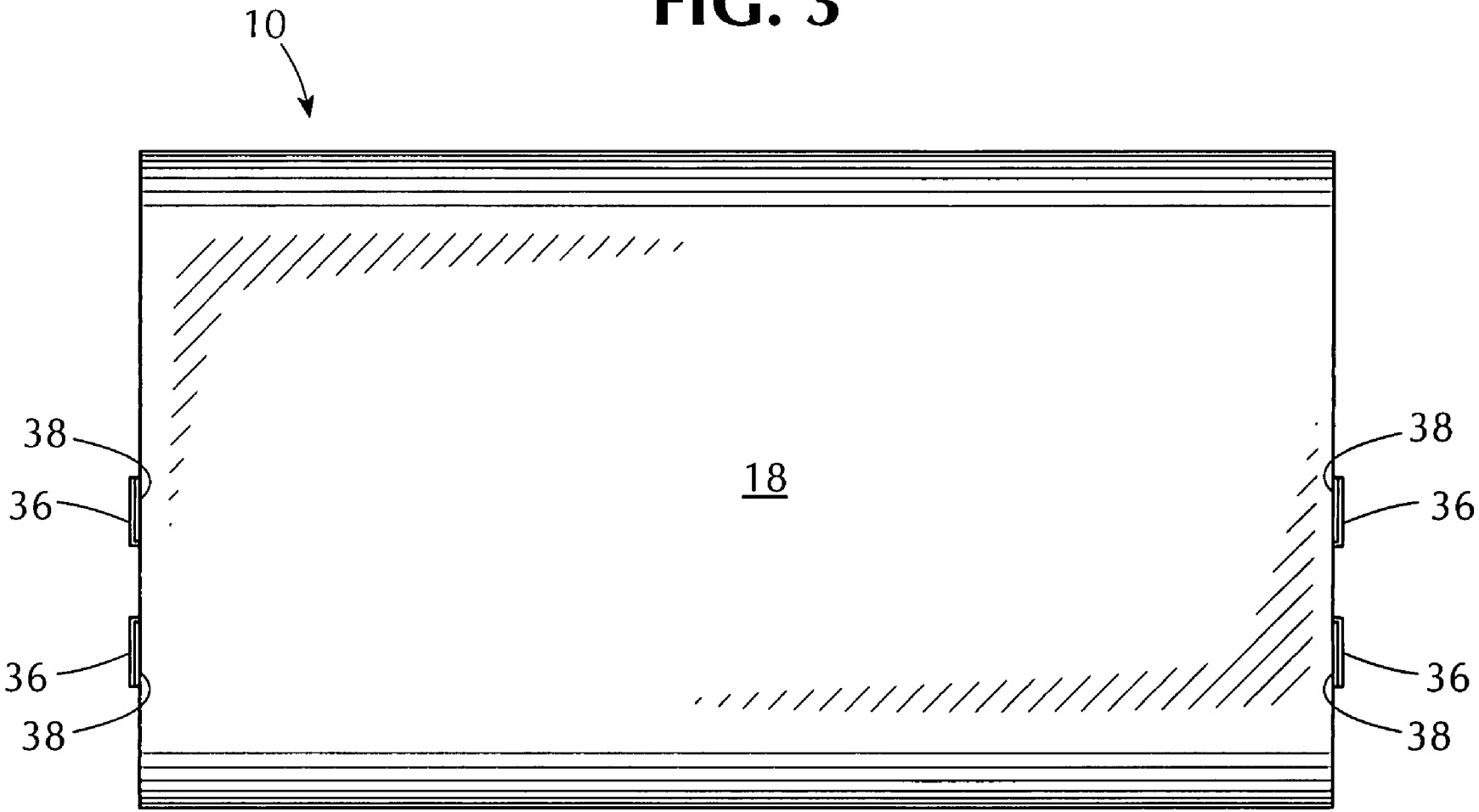
FIG. 3 is a rear view of the towel roll holder and dispenser shown in FIG. 1.
Figure 4:
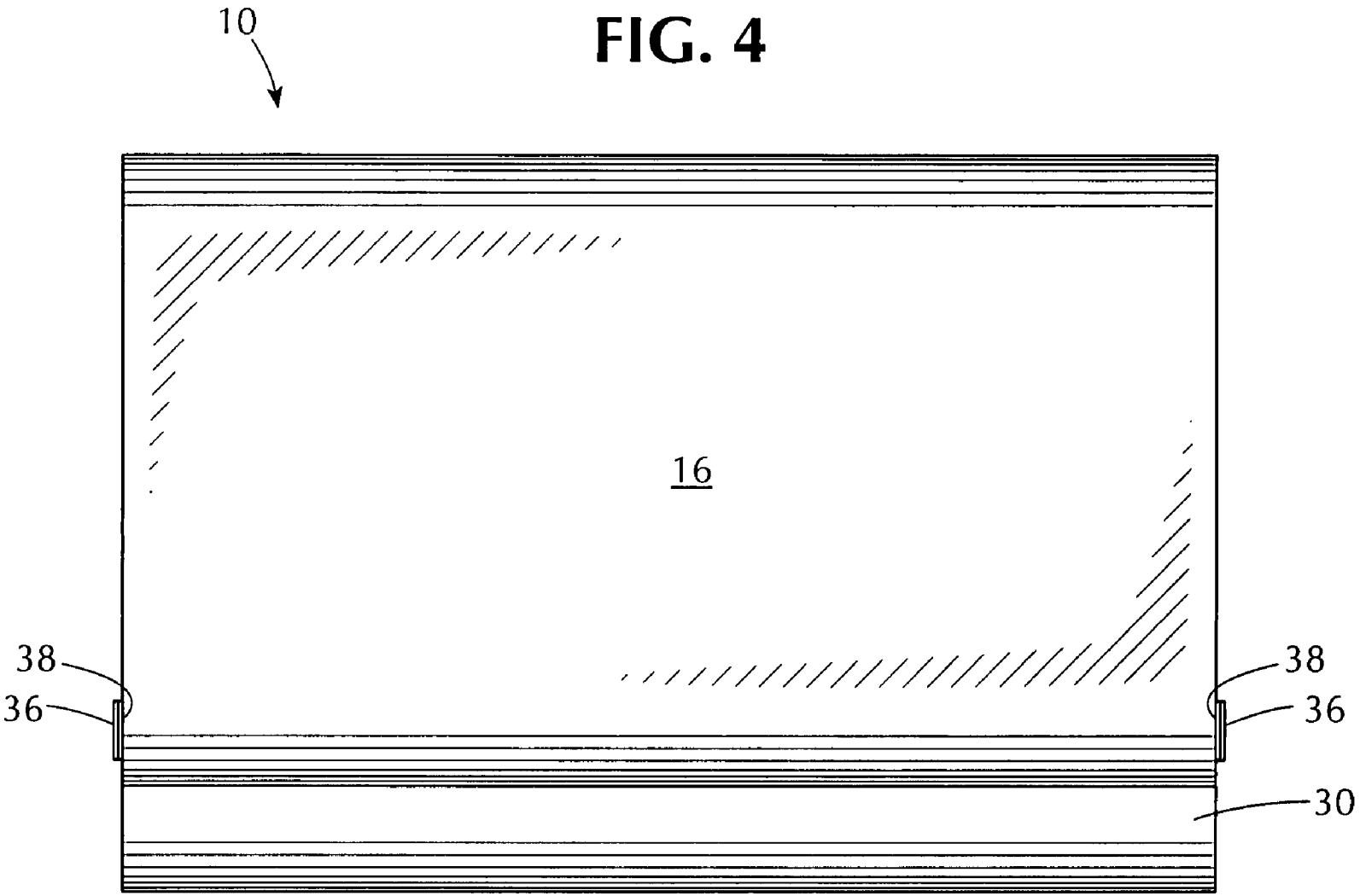
FIG. 4 is a top view of the towel roll holder and dispenser shown in FIG. 1.
Figure 5:
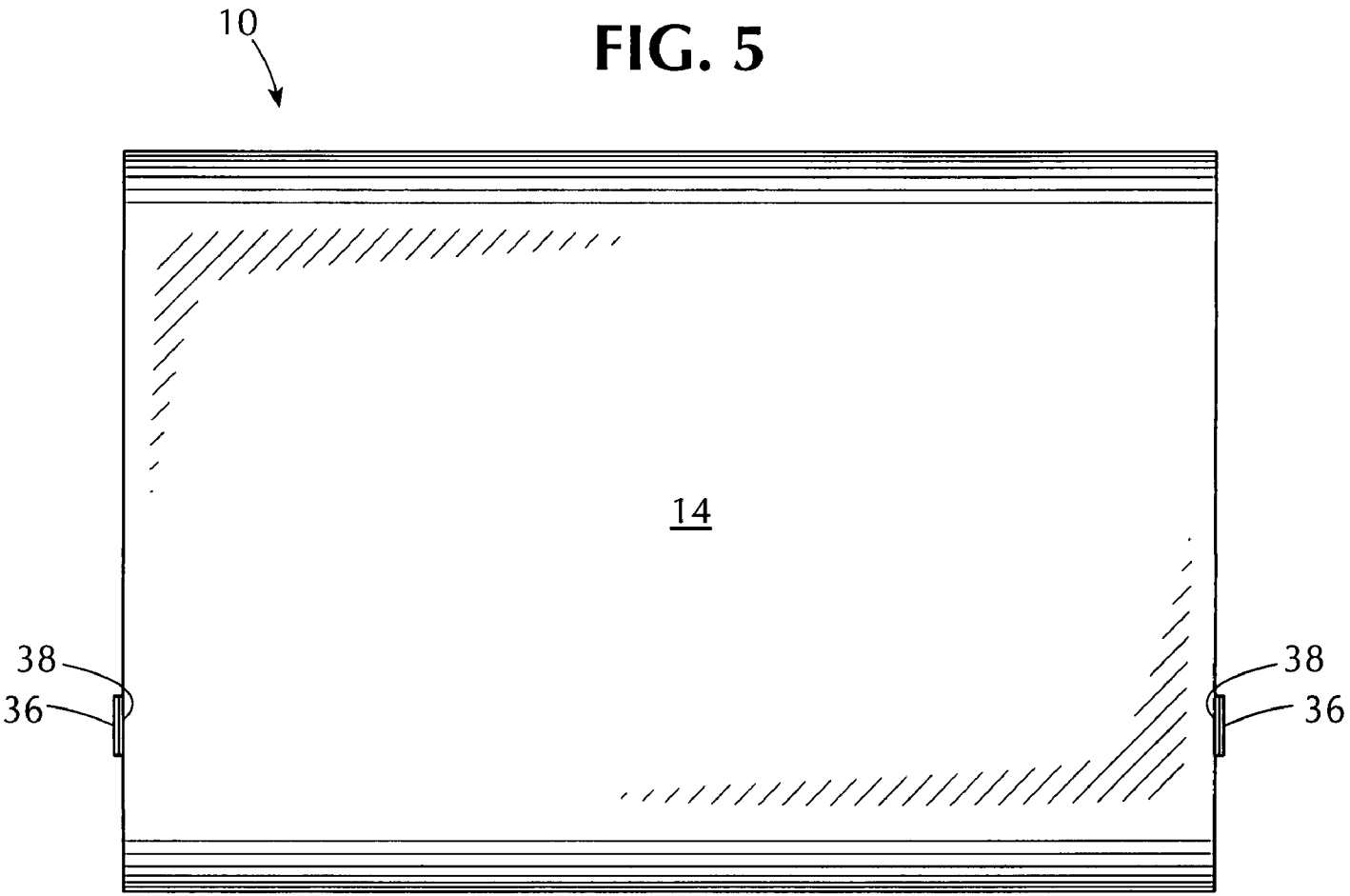
FIG. 5 is a bottom view of the towel roll holder and dispenser shown in FIG. 1.
Figure 7:
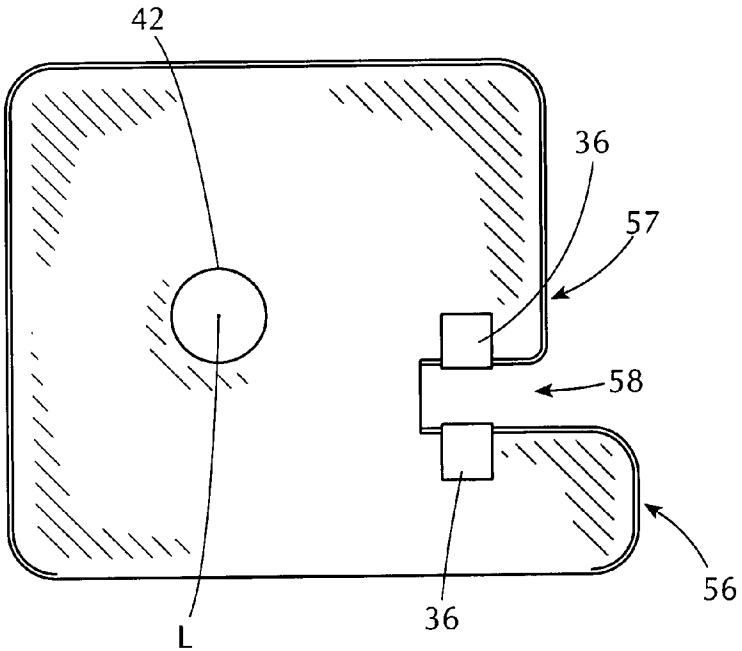
FIG. 7 is a left-side view of the towel roll holder and dispenser shown in FIG. 1.
Figure 6:
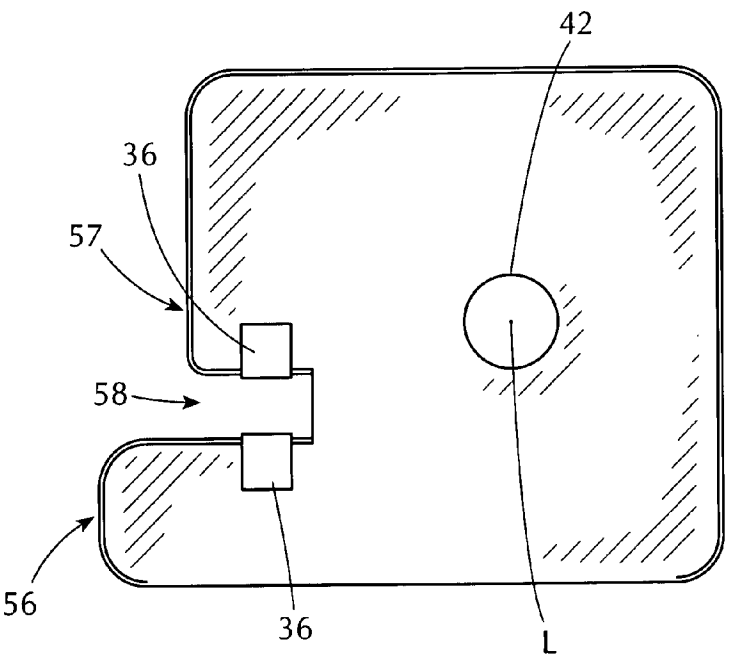
FIG. 6 is a right-side view of the towel roll holder and dispenser shown in FIG. 1.
Figure 8:
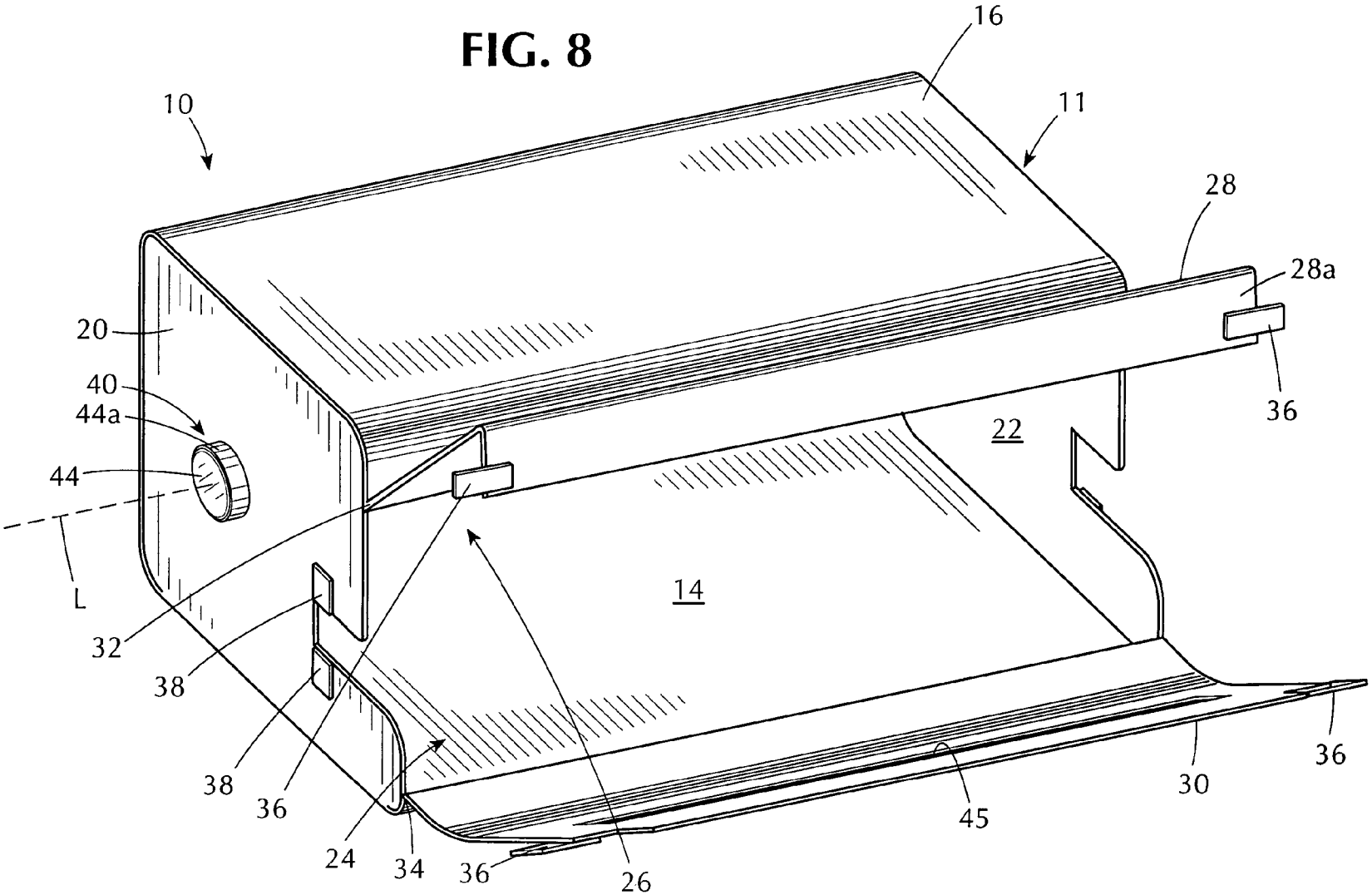
FIG. 8 is a perspective view of the towel roll holder and dispenser shown in FIG. 1 showing the cover members in an open position.

Referring to FIGS. 1, 2 and 8, the towel roll holder and dispenser 10 further includes a cover structure pivotally attached to the main body 12 for covering the open front end 24 of the main body 12 when the cover structure is in a closed position. The cover structure comprises first and second cover members 28, 30 pivotable in opposing directions between the closed position (as shown in FIG. 1) and an open position (as shown in FIG. 8). The first cover member 28 has a first longitudinal edge portion connected to a front edge portion 16*a* of the top 16 by means of a first hinge portion 32. An overturned portion 28*a* of the first cover member 28 extends from a second longitudinal edge portion opposite the first longitudinal edge portion thereof. The cover member 30 is connected to a front edge portion 14*a* of the bottom 14 by means of a second hinge portion 34. The first and second cover members 28, 30 and the main body 12 together define a container 11 fully enclosing the roll of towels when the first and second cover members 28, 30 are in the closed position.

The towel roll holder and dispenser 10 further includes holding means for releasably holding each of the first and second cover members 28, 30 in the closed position as shown in FIG. 1. The holding means comprises fasteners 36 mounted on the overturned portion 28*a* of the first cover member and on the second cover member 30, and fasteners 38 mounted on the end walls 20, 22 for releasable connection to the fasteners 36. FIG. 1 shows the state in which the fasteners 36, 38 are releasably connected to one another, and in FIG. 8 the fasteners 36, 38 are shown in a released state. Preferably, the fasteners 36, 38 comprise hook and loop fabric fastener tabs, such as VELCRO strips. It is understood, however, that other forms of releasable fasteners are suitable for releasably holding the first and second cover members 28, 30 in the closed position. For example, the releasable fasteners may comprise magnetic strips or snap buttons.

A retaining mechanism (retaining means) 40 rotatively retains the roll of paper towels T within the container 11 between the pair of end walls 20, 22 so that a free end portion T1 of the paper towel T can extend through the open front end 24 of the main body 12. The retaining mechanism 40 includes the end walls 20, 22 of the main body 12 having aligned apertures 42 therethrough. An elongated rod 44 has end portions 44*a* which extend through the aligned apertures 30 to carry the roll of paper towels T with the end portions 44*a* bearing against inner surface portions of the end walls forming the apertures 42.

An elongated longitudinal slot 45 is formed in the second cover member 30 to facilitate dispensing of the paper towels T from the roll of paper towels enclosed by the container 11. The slot 45 is bounded in part by a pair of confronting longitudinal edges 30*a*, 30*b* defining a portion of the perimeter of the slot 45 and which function as cutting edges for tearing the severable sheets of paper towels T from the roll of paper towels during a dispensing operation. For example, with reference to FIG. 1, tearing of a sheet of paper towel T may be accomplished by pulling out the free end portion T1 of the paper towel T from the slot 45 until the line of perforations on the sheet are positioned approximately adjacent to the perimeter (i.e., the longitudinal edges 30*a*, 30*b*) of the slot 45. The user then tears the sheet along the perimeter of the slot 45 to separate the sheet from the roll.

In the embodiments shown in the drawings, the slot 45 extends generally parallel to a longitudinal axis L of the rod 44 which is in a horizontal orientation in FIG. 2. However, in an alternative embodiment, and in order to facilitate separation or tearing apart of paper towels T from the roll, the slot 45 may be formed at an angle to the longitudinal axis L of the rod 44. The angle of the slot 45 may vary, and the orientation may vary from either direction away from the horizontal. In addition, the slot 45 may be either a straight line or curved. The angling of the slot 45 and the optional curving of the slot 45 are not only decorative, but functionally assist in tearing the paper towels T off the roll of paper towels. Stated otherwise, by angling the paper towels T away from the horizontal axis, the paper towels T may be more easily separated. In addition, this prevents the inadvertent pulling of more paper towels T from the inside of the container 11. For example, the slot 45 may angle in the range of 1 degree from the horizontal axis to plus or minus 45 degrees from the horizontal axis.

Moreover, in the embodiments shown in the drawings, the slot 45 is formed in a horizontal surface portion 30*c* of the second cover member 30. It is understood, however, that the slot 45 may instead be formed in a vertical surface 30*d* of the second cover member 30 without departing from the spirit and scope of the invention.

Figure 12:
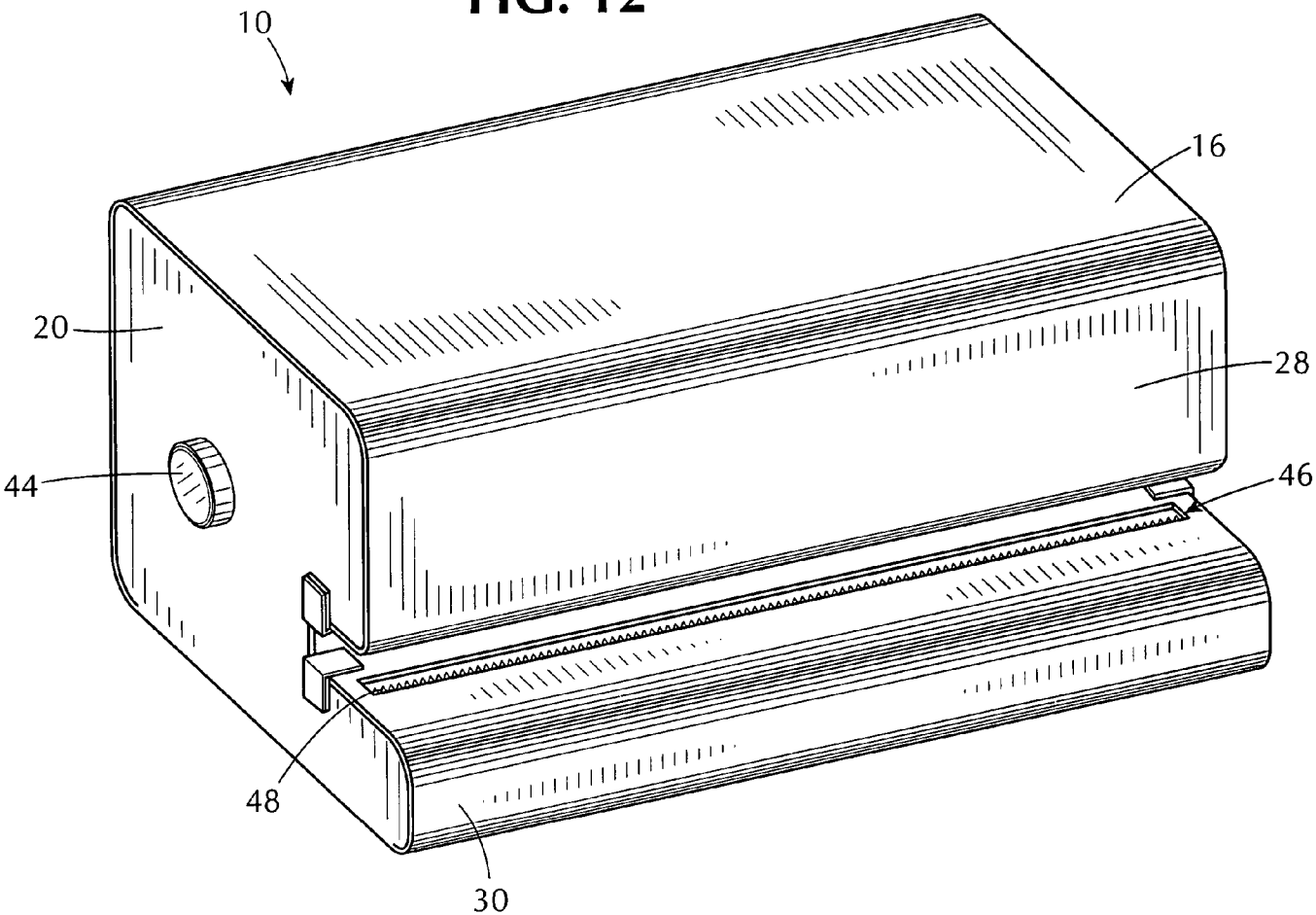
FIG. 12 is a perspective view of a towel roll holder and dispenser according to another embodiment of the present invention.

In an alternative embodiment, as shown in FIG. 12, a tearing mechanism 46 (tearing means) is disposed along the longitudinal edge 30*b* of the second cover member 30 for tearing off the paper towel T from the roll. The tearing mechanism 46 preferably comprises a serrated cutting member 48 comprising a row of generally triangularly-shaped, small, closely-spaced cutting teeth. For example, the serrated cutting member 48 may be of the type commonly used in boxes for dispensing aluminum foil or plastic. In this case, the serrated cutting member 48 comprises a strip of material having the closely-spaced teeth, and the strip of material is integrally connected (e.g., bonded) to an inner surface of the second cover member 30 so that the cutting teeth project beyond the edge 30*b* as shown in FIG. 12. It is understood, however, that the tearing mechanism 46 may be in the form of a continuous cutting edge surface instead of a row of cutting teeth.

Figure 9:
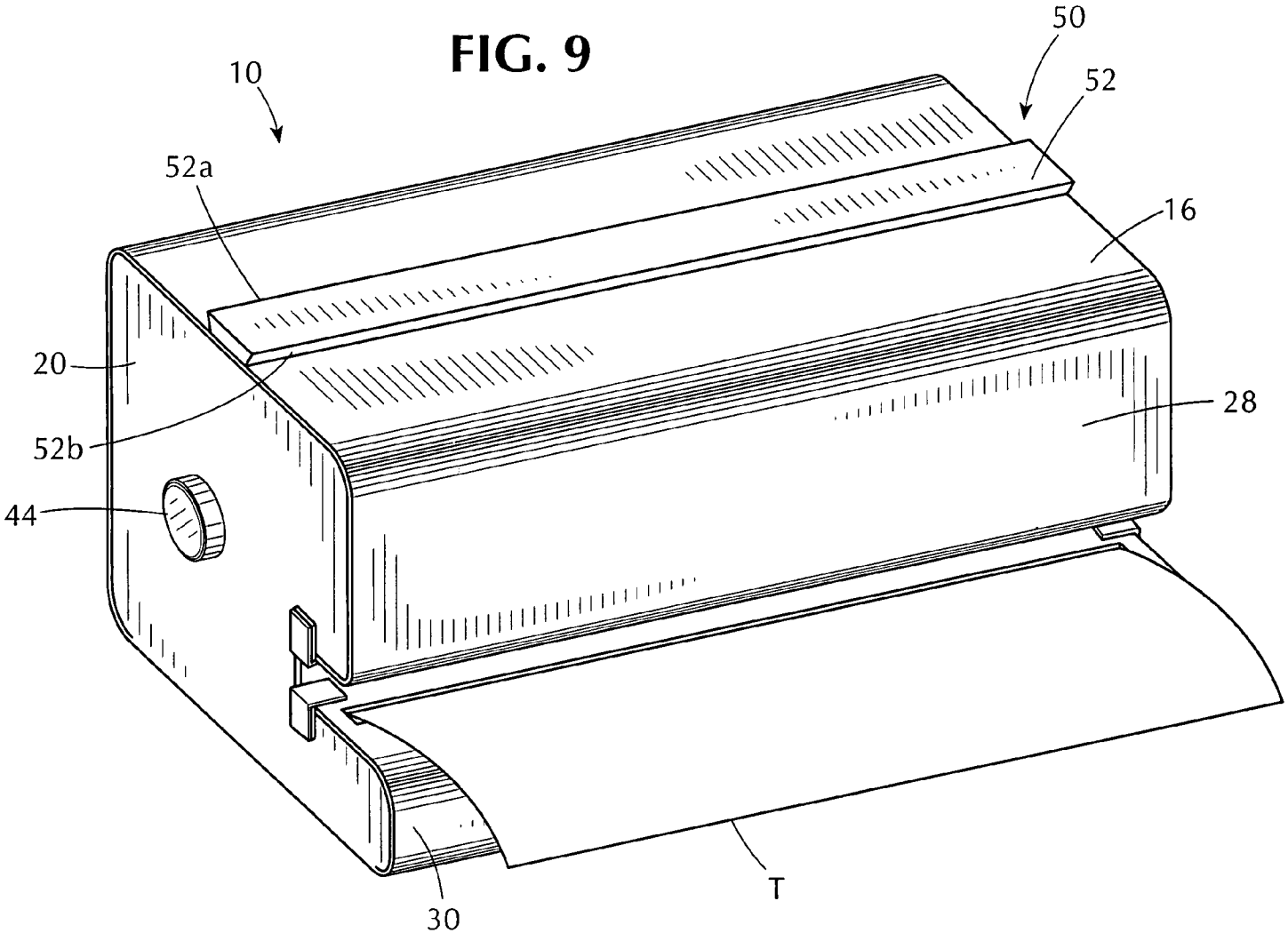
FIG. 9 is a perspective view of a towel roll holder and dispenser according to another embodiment of the present invention.

FIG. 9 shows another embodiment of the towel roll holder and dispenser 10 according to the present invention. The towel roll holder and dispenser 10 has the same structure as discussed above for the embodiment of FIGS. 1-8. In addition, the towel roll holder and dispenser 10 of FIG. 9 includes a securing mechanism 50 (securing means) for securing the container 11 to a support structure (not shown), such as a wall, cabinet, appliance or other surface. In the embodiment of FIG. 9, the securing mechanism comprises a plate 52 integrally connected to the top 16 of the main body 12 by suitable adhesives or fasteners. The plate 52 has a pair of longitudinal edges 52*a*, 52*b* configured to be received in a slidable manner by a corresponding channeled member (not shown) mounted on the support structure. The plate 52 may be formed of a suitable plastic or metallic material.

However, it will be appreciated that the container 11 can be mounted to a support structure in a number of other ways. For example, a plurality of magnetic strips may be secured to the top 16 of the main body 12 to allow the container 11 to be secured to a support structure made of a ferromagnetic material. Alternatively, a plurality of VELCRO strips can be secured to the top 16 of the main body 12 in lieu of the magnetic strips and affixed to complementary VELCRO strips mounted on the cabinet or other support surface. In yet another alternative embodiment, the container 11 can be mounted to the support structure by means of screws, the rear wall 18 of the housing 12 being provided with key slots, for example, for this purpose.

It will also be appreciated that each of the securing mechanisms described above can be mounted to the bottom 14 or rear wall 18 of the main body instead of the top 16. For example, the securing mechanism may be mounted to the rear wall 18 of the main body when the support structure that the container 11 is to be mounted is a vertical wall. When the support structure that the container 11 is to be mounted is a horizontal surface of a counter top, for example, the securing mechanism is mounted on the bottom 14 of the main body 12.

Figure 11:
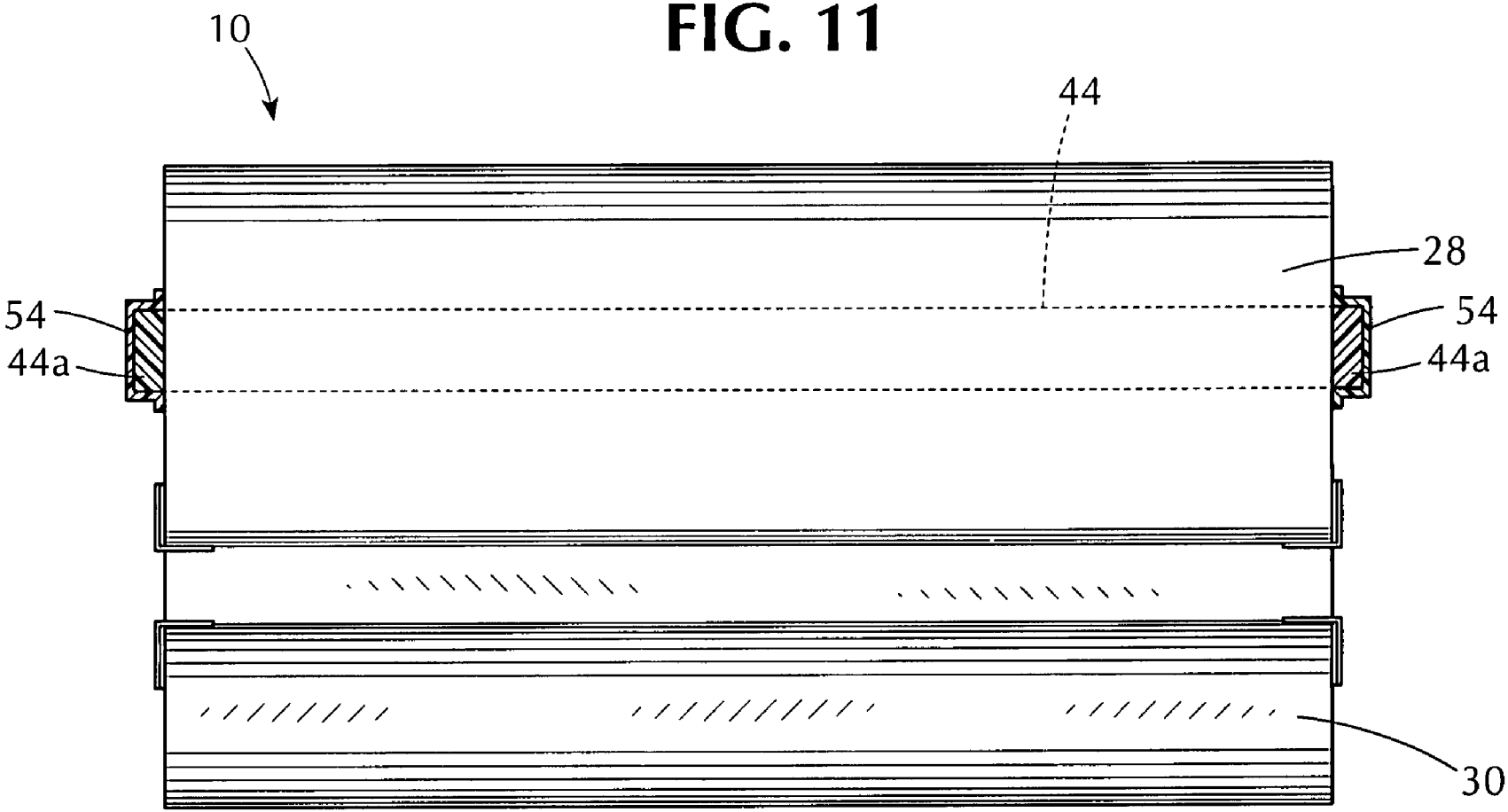
FIG. 11 is a perspective view of a towel roll holder and dispenser according to another embodiment of the present invention.

FIG. 11 shows another embodiment of the towel roll holder and dispenser 10 according to the present invention. The towel roll holder and dispenser 10 has the same structure as discussed above for the embodiment of FIGS. 1-8. In addition, the towel roll holder and dispenser 10 of FIG. 11 includes a pair of tubular end caps 54 configured and dimensioned to removably receive the respective end portions 44*a* of the elongated rod 44 for restraining displacement of the elongated rod 44 along the longitudinal axis of the elongated rod 44. The end portions 44*a* of the elongated rod 44 are preferably connected to the end caps 54 with a friction fit which is sufficient to maintain connection between the end portions 44*a* and the end caps 54 during a towel dispensing operation, but which is also capable of allowing a user to disconnect by and the end caps 54 from the end portions 44*a* to permit removal of the elongated rod 44 from the container 11, or at least withdrawal of the elongated rod 44 in the longitudinal direction thereof, during replacement of a new roll or paper towels. Alternatively, the inner surfaces of the end caps 54 and the outer surfaces of the end portions 44*a* of the elongated rod 44 may be formed with suitable threaded portions for removable threaded engagement therebetween. In yet another variation, the end caps 54 and the end portions 44*a* of the elongated rod 44 can be connected together using manually adjustable set screws extending through through-holes formed in the end caps and contacting the outer surfaces of the end portions 44*a* of the elongated rod 44. The end caps may be formed from a suitable plastic or metallic material.

Prior to being used, the container 11 is secured to a support structure preferably of the type and in the manner described above. In order to mount a roll of paper towels T in the container 11, the cover structure is first placed in the open position as shown in FIG. 8 by releasing the fasteners 36, 38 and pivoting the first and second cover members 28, 30 in opposing directions away from the open front end 24 of the main body 12. The elongated rod 44 is then manually displaced along the longitudinal axis thereof at least until sufficient space is provided in the open space of the main body 12 to allow insertion of a new roll of paper towels T in the open space and permit the elongated rod 44 to be passed through the roll. The elongated rod 44 is then displaced along the longitudinal axis until the end portions 44*a* thereof extend through the aligned apertures 30 of the end walls 20, 22 to carry the roll of paper towels T as described above.

Thereafter, prior to closing the first and second cover members 28, 30 of the cover structure, the end portion T1 of the severable leading sheet of paper towel T from the roll of paper towels is positioned through the slot 45 formed in the second cover member 30. The cover structure is then closed with the interlocking hook and loop fabric fastener tabs 36, 38 by pivoting the first and second cover members 28, 30 towards one another to place the container 11 in the readyto-use configuration shown in FIG. 1. When the user of the container 11 needs to remove a sheet of the paper towel T from the roll of paper towels, he or she grasps the end portion T1 of the sheet and pulls the same from the slot 45 until the perforation on the sheet are positioned approximately adjacent to the perimeter (i.e., the longitudinal edges 30*a*, 30*b*) of the slot 45. The user then tears the sheet of paper towel T1 along the perimeter of the slot 45 to separate the sheet from the roll. This procedure is applicable to each of the foregoing described embodiments in which the sheet is torn directly by the longitudinal edge 30*a* or 30*b* of the slot (e.g., disposed either parallel or at an angle relative to the longitudinal axis L of the rod 44) or by a tearing mechanism (e.g., the serrated cutting member 48) disposed along the longitudinal edge 30*a* or 30*b* of the slot 45. When the last sheet of paper towel T1 is removed from the roll, a fresh roll is inserted in the container 11 as described above.

In the foregoing embodiments of the towel roll holder and dispenser 10 according to the present invention, the main body 12 and the cover structure (first and second cover members 28, 30) forming the container 11 are preferably a one-piece structure formed from a single piece of material. For example, the single piece of material is an injection molded plastic preferably comprised of polyvinyl chloride or other similar polymeric material. The plastic material may be transparent, opaque, or translucent. A transparent material will enable a user to visually determine the amount of paper towels T left on the roll. For more decorative applications, the plastic may be colored or tinted. Alternatively, the single piece of material may be cardboard, wood, or a suitable metal, such as that formed from brushed aluminum or steel.

It is understood by those of ordinary skill in the art that it is not essential that the container be a one-piece structure formed from a single piece of material. In this regard, several alternatives are contemplated for the structure of the container 11. For example, the main body 12 may be a one-piece structure formed from a single piece of material, and the first and second cover members 28, 30 may each be formed as separate and independent components and then connected to the corresponding portions of the top 16 and bottom 14 via a suitable hinge connection so that the first and second cover members 28, 30 are pivotable in opposing directions between the closed position (FIG. 1) and the open position (FIG. 8). Alternatively, each of the bottom 14, top 16, rear wall 18, and pair of opposing end walls 20, 22 of the main body 12 may be formed as separate and independent components and then connected together to form the main body 12 using, for example, a suitable bonding agent, such as glue, or suitable fastening members, such as an adhesive tape or brackets. When the main body 12 and the cover structure of the container 11 is formed from separate and independent components from a suitable plastic material, for example, one or more of the components of the main body 12 and/or the cover structure may be transparent to enable visual perception of the roll of paper towels T to determine the amount of paper towels T left on the roll.

Another feature of the towel roll holder and dispenser 10 according to the present invention is described with reference to FIGS. 1, 6, 9 and 12. As shown in these figures, the container 11 is preferably generally G-shaped in cross-section. Other than providing an aesthetic appearance to the overall structure of the container 11, the generally G-shaped cross-section of the container 11 provides a specific structural configuration which facilitates dispensing of the sheets of towels T. More specifically, as best shown in the right- and left-side views of FIGS. 6 and 7, respectively, the G-shaped cross-sectional shape forms portions 56, 57 of the container 11 separated by a space 58. The portion 56, which includes the second cover member 30 provided with the slot 45, protrudes or extends further from the portion 56 in a direction generally perpendicular to the longitudinal axis L of the rod 44. As is best appreciated from the perspective view of the towel roll holder and dispenser 10 shown in FIG. 1, the further extension of the portion 56 provides a clearance between the portions 56 and 57 which facilitates dispensing (i.e., pulling and tearing) of the sheet of towel T1 during a dispensing operation.

Figure 10:
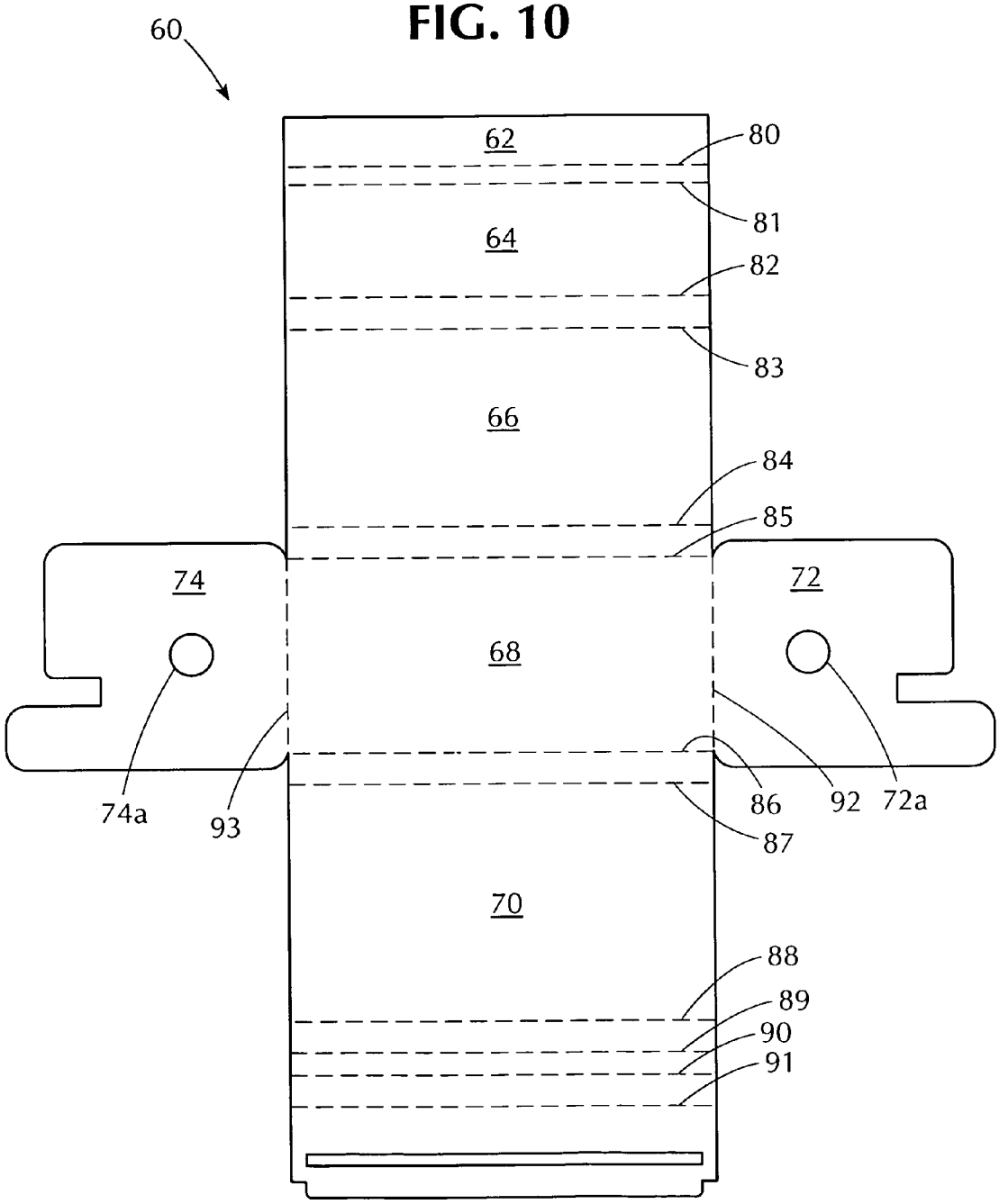
FIG. 10 is a plan view of a blank for forming the container of the towel roll holder and dispenser according to the present invention.

FIG. 10 shows another aspect of the present invention which is directed to a blank, generally designated at 60, for forming the container 11 (i.e., body 12 and first and second cover members 28, 30) of the towel roll holder and dispenser 10 according to the present invention.

The container blank 60 is comprised of a main body formed of a unitary piece of material having a substantially planar shape. The blank 60 has a plurality of first panels 62, 64, 66, 68, 70 and a plurality of second panels 72, 74. The first panels 62, 64, 66, 68, 70 correspond to the first cover member 28, top 16, rear wall 18, bottom 14, and second cover member 30, respectively, and the second panels 72, 74 correspond to the end walls 20, 22, respectively, of the container 11 in the assembled towel roll holder and dispenser 10 as described above with respect to the embodiment of FIGS. 1-8, for example. The panel 70 has a longitudinal slot 70*a* corresponding to the elongated longitudinal slot 45 formed in the second cover member 30 of the container 11. A pair of side panels 72, 74 extending from opposite side edges of the panel 68 correspond to the pair of opposing end walls 20, 22 of the container 11. The side panels 72, 74 have apertures 72*a*, 74*a* corresponding to the aligned apertures 42 of the end walls 20, 22.

The panels 62-70 are separated by corresponding fold lines 80-91 as shown in FIG. 10. The side panels 72, 74 are separated from the panel 68 by fold lines 92, 93, respectively. The fold lines 80-91 are disposed generally parallel to one another. The fold lines 92-93 are disposed generally parallel to one another and generally perpendicular to the fold lines 80-91. By use of the fold lines 80-93, each of the various panels and side panels are foldable with respect to one another to form the container 11 of the towel roll holder and dispenser 10 according to the present invention.

The blank 60 may be formed (e.g., injection molded) from a suitable plastic material as described above for the container 11. Alternatively, the blank 60 may be formed from a suitable high-grade carton material or from single or multilayered sheets of material. Upon folding about the corresponding fold lines, the panels 62-70 and side panels 72, 74 are secured to each other along corresponding longitudinal edge portions thereof using suitable fastening means, such as a suitable adhesive. Alternatively, where the blank 60 is made of a plastic, a plastic coated, or a plastic impregnated material, the adhesive material may be eliminated, the blank material being self-sealing upon the application of heat as is well-known in the art. Furthermore, in the embodiment shown in FIG. 10, the portion of the blank 60 forming the panels 62-70 is generally rectangular-shaped in plan view and the side panels 72, 74 are generally G-shaped in plan view so that upon assembly, the blank 60 forms the container 11 in the configuration shown and described above with respect to the embodiments of FIGS. 1-9 and 11-12. It is understood, however, that the blank 60 may be manufactured in any desired shape to form the container 11 in a correspondingly desired configuration.

Thus it will be appreciated from the foregoing description that the present invention provides a towel roll holder and dispenser having a container for retaining a roll of toweling made, for example, of paper, cloth, fabric, or the like, so that the individual towels of the roll can be easily dispensed therefrom, and so that a new roll can be quickly and easily inserted into the container when the old one is exhausted. The towel roll holder and dispenser prevents towels from the roll from becoming dirty by keeping the towels in a clean and sanitary condition prior to being dispensed from the towel roll holder and dispenser.

Moreover, the towel roll holder and dispenser of the present invention is easily affixed to a support structure, such as a wall, cabinet, appliance or other surface, and is easily opened for replacement of the roll. The towel roll holder and dispenser of the present invention is simple and easy to use, is easy and economical to manufacture, may be manufactured in any size and weight, and is highly durable and resistant to structural or performance degradation.

From the foregoing description, it can be seen that the present invention comprises an improved towel roll holder and dispenser and to a blank made of a unitary sheet of material for forming a container for the towel roll holder and dispenser. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

We claim:

1. A towel roll holder and dispenser comprising:

a main body having a bottom, a top, a rear wall, a pair of opposing end walls, and an open front end, the bottom, top, rear wall and end walls defining an open space for receiving and containing a roll of towels for dispensing;

a cover structure pivotally attached to the main body for closing off the interior space of the main body when in a closed position, the cover structure having first and second cover members pivotable in opposing directions between the closed position and an open position, the first and second cover members and the main body together defining a container fully enclosing the roll of towels when the first and second cover members are in the closed position;

holding means for releasably holding each of the first and second cover members in the closed position; and means defining a dispensing opening formed in the first cover member and through which a towel from the roll of towels can be dispensed from the container when the first cover member is in the closed position.

2. A towel roll holder and dispenser according to claim 1; wherein the means defining a dispensing opening comprises an elongated aperture formed in the first cover member.

3. A towel roll holder and dispenser according to claim 2; further comprising retaining means for rotatively retaining the roll of towels within the open space of the main body between the pair of end walls so that a free portion of a towel from the roll of towels can extend through the elongated aperture of the first cover member; and tearing means disposed along an edge of the elongated aperture for tearing off the free portion of the towel.

4. A towel roll holder and dispenser according to claim 3; wherein the retaining means comprises the end walls of the main body having aligned apertures therethrough, and an elongated rod having opposite end portions extendable through the respective aligned apertures of the end walls.

5. A towel roll holder and dispenser according to claim 4; further comprising a pair of tubular end caps configured and dimensioned to receive onto the respective end portions of the elongated rod for restraining displacement of the elongated rod along a longitudinal axis thereof.

6. A towel roll holder and dispenser according to claim 3; wherein the tearing means comprises a serrated cutting member.

7. A towel roll holder and dispenser according to claim 1; wherein the holding means comprises a plurality of hook and loop fabric fastener tabs mounted on the first and second cover members and on the side walls of the main body so as to releasably hold the first and second cover members to the side walls of the main body.

8. A towel roll holder and dispenser according to claim 1; wherein the enclosure is a one-piece structure made from a single piece of material.

9. A towel roll holder and dispenser according to claim 8; wherein the single piece of material is transparent.

10. A towel roll holder and dispenser according to claim 1; wherein the enclosure is formed of a transparent material that enables visual perception of the roll of towels when enclosed by the enclosure.

11. A towel roll holder and dispenser according to claim 1; further comprising securing means for securing at least one of the bottom, top and rear wall of the main body to a support structure.

12. A towel roll holder and dispenser according to claim 11; wherein the securing means comprises at least one magnetic strip secured to the at least one of the bottom, top and rear wall of the main body.

13. A towel roll holder and dispenser according to claim 11; wherein the securing means comprises a plurality of two part hook and loop fasteners, one of the parts being secured to the at least one of the bottom, top and rear wall of the main body and the other of the parts being adapted to be secured to the support structure.

14. A towel roll holder and dispenser according to claim 1; wherein in the closed position of the first and second cover members, the main body and the first and second cover member form a housing having a generally G-shaped cross-section.

15. A towel roll holder and dispenser adapted for mounting on a support surface, the towel roll holder and dispenser comprising: a housing for receiving a towel roll therewithin, the housing having a pair of sidewalls, a base connected to the sidewalls for mounting the housing on the support surface, and a pair of cover members pivotable in opposing directions between a closed position and an open position, one of the cover members having an opening through which towels may be dispensed from the towel roll; and a plurality of fasteners for releasably fastening the cover members to the sidewalls of the housing.

16. A towel roll holder and dispenser according to claim 15; wherein the housing is a one-piece structure made from a single piece of material.

17. A towel roll holder and dispenser according to claim 15; wherein the single piece of material is injection molded plastic.

18. A container blank made of a unitary piece of material for forming a container, the container blank comprising: a plurality of first panels separated by a plurality of first fold lines about which the first panels are foldable to form a bottom, a top, a rear wall, a first cover member and a second cover member of the container; and a pair of second panels extending from opposite longitudinal edge portions of a preselected one of the first panels forming bottom of the container, the second panels being separated from the longitudinal edge portions of preselected panel by respective second fold lines about which the respective second panels are foldable to form opposing end walls of the container; wherein the first panel forming the first cover member has a longitudinal slot disposed generally parallel to the first fold lines; and wherein the second panels have through-holes forming aligned apertures when the second panels are folded about the second fold lines to form the opposing end walls of the container.

19. A container blank according to claim 18; wherein the first panels form a generally rectangular-shaped structure; and wherein each of the second panels is generally G-shaped.

* * * * *